US006855096B2

(12) United States Patent
Quiros Granados

(10) Patent No.: US 6,855,096 B2
(45) Date of Patent: Feb. 15, 2005

(54) RAISABLE PLATFORM FOR STATIONARY BIKES

(76) Inventor: Manuel Quiros Granados, C/ de la Hera no. 16-18, 08221 Terrassa (Barcelona) (ES)

( * ) Notice: Subject to any disclaimer, the term of this patent is extended or adjusted under 35 U.S.C. 154(b) by 361 days.

(21) Appl. No.: 10/077,655

(22) Filed: Feb. 13, 2002

(65) Prior Publication Data

US 2003/0153435 A1 Aug. 14, 2003

(51) Int. Cl.[7] ..... A63B 22/06; A63B 69/16
(52) U.S. Cl. ..... 482/57; 482/61
(58) Field of Search ..... 482/51–53, 54, 482/57–65, 148, 142

(56) References Cited

U.S. PATENT DOCUMENTS 3,744,794 A * 7/1973 Gause et al. ..... 482/57
3,750,479 A * 8/1973 Gause et al. ..... 73/379.07
5,888,172 A * 3/1999 Andrus et al. ..... 482/7
5,910,070 A * 6/1999 Henry et al. ..... 482/4
6,126,577 A * 10/2000 Chang ..... 482/57
6,551,219 B1 * 4/2003 Brown ..... 482/57

* cited by examiner

*Primary Examiner*—Stephen R. Crow
(74) *Attorney, Agent, or Firm*—Collard & Roe, P.C.

(57) ABSTRACT

The Invention consists of a raisable platform for stationary bicycles, consisting of a special construction of the platform, of a rectangular general mounting provided with means for anchoring stationary bicycles of every type. This support pivots about its back end and has a forward placed pincers device with motorised opening that allows the raising of the mounting and the bicycle, imitating the different slopes of a trip.

6 Claims, 4 Drawing Sheets

RAISABLE PLATFORM FOR STATIONARY BIKES

PURPOSE OF THE INVENTION

The invention here proposed consists of a raisable platform for stationary bikes, among the means of support of articles for the practice of stationary sports, of indoor track cycling and pursuit, of conventional road bikes, mountain and recreational bikes, with or without rollers, or whatever other type of bike.

A special platform construction characterises this invention. A rectangular general mounting provided with means of anchoring stationary bikes of every type, capable of pivoting about the back end, and with a forward placed pincers device, with motorised opening for raising the mounting and the bike, imitating the rises and falls of a trip.

BACKGROUND TO THE INVENTION

At present stationary bikes have supports pertaining to each make, with different construction and profile, even though practically all of them have double side supports, front and back.

The applicant does not know of the existence of platforms adaptable for any type of bike, and that, furthermore, imitate the unevenness of a theoretical trip, and that may be programmed by choice.

DESCRIPTION OF THE INVENTION

The invention that is the object of this report refers to a raisable platform for stationary bikes, among all those means of support for articles for the practice of stationary sports, both in its individual application and collective use, coordinated or not, which might be gymnasiums or sport tournaments, indoor track cycling and pursuit, of conventional road bikes, mountain and recreational bikes, with or without rollers, or whatever other type of bike.

A special construction of the platform characterises this invention. This is made up of a rectangular general mounting, with a base plate and side metal strips, the longer of these being covered by convex curved decorative covers, interchangeable between the two sides, and that delimit a general frame.

These curved sections, as well as avoiding tripping by the user, house in longitudinal cut-outs the front support wheels of the end of a metal section cut like a ratchet.

The base plate is provided with means for anchoring stationary bicycles of every type and this general mounting is capable of pivoting at the back end, about a base of a pair of irregular triangular plates, vertically supported, and the two sides with symmetrical cut-outs, having a rounded and holed upper projection, to accept a hinging pin, for the stated pivoting of the general mounting.

This invention has a casing, beside the short front side of the general mounting, that incorporates means of raising, by means of a forward placed device with two pincers, positioned in a forward inclined plane, with opposing mouths and with mutually self-embedding lips, with step-by-step motorised opening, for the joint raising of the mounting and bicycle, imitating the rises and falls of a theoretical trip in the open air.

For this, these pincers have, on their respective hinging axles, on one a rounded tubular housing with threaded interior that receives the axial advance of the other section of smaller diameter, with free passage through the hinge of the opposite pincer which is connected with the motor.

In this way the advance of the single or intermediate tubular section of one of the pincers along the housing joined to the other, causes an opening of both opposing pincers to the maximum opening position of these mouths.

The upper lips of both pincers are joined to a forward bridge that supports their forward inclined and upper part and that is bolted to bolts that slide along the guide of a forward transverse metallic section, preferably of aluminium, while this support triangulates in the most inner part by means of a obliquely positioned metal piece, lightly bent in the area of attachment to the bridge, and fully bent to the horizontal in the lower area, fixed to the forward edge of the base plate.

This triangular support strip, having its respective ends fixed causes that the opening of the pincers forces the movement of the wheels along the curved section path, a drawing together of the pincers and, since the metal section in the shape of a ratchet is joined at its central part to a "U" for locking the lower lips of the pincers, through a intermediate transverse section, all of this causes the raising of the ratcheted strip.

This raising causes the raising of the general mounting with respect to the other end of this sheet section, free and connected to a wheel, joined to the opposite section by a common axle which, in turn, moves towards the interior of the mounting projection, during its raising, thus achieving the effects of progressive unevenness during the peddling by the user of the stationary bicycle, until reaching 34° with respect to the horizontal, easily controlled from a control incorporated in the handlebars or remotely, by cable or by remote control, the possibility existing that a central computer might program a large number of different rises and descents for a specific trip that might reproduce the difficulties of a circuit, previously copying the ups and downs of its route, and making the mounting follow, with the precision required, the unevenness of each section, logically starting from a zero level that doesn't have and negative slopes.

DESCRIPTION OF THE DRAWINGS

The present descriptive report is complemented by a set of drawings, illustrating the preferred example of the invention.

PREFERABLE REALIZATION OF THE INVENTION

Figure 1:
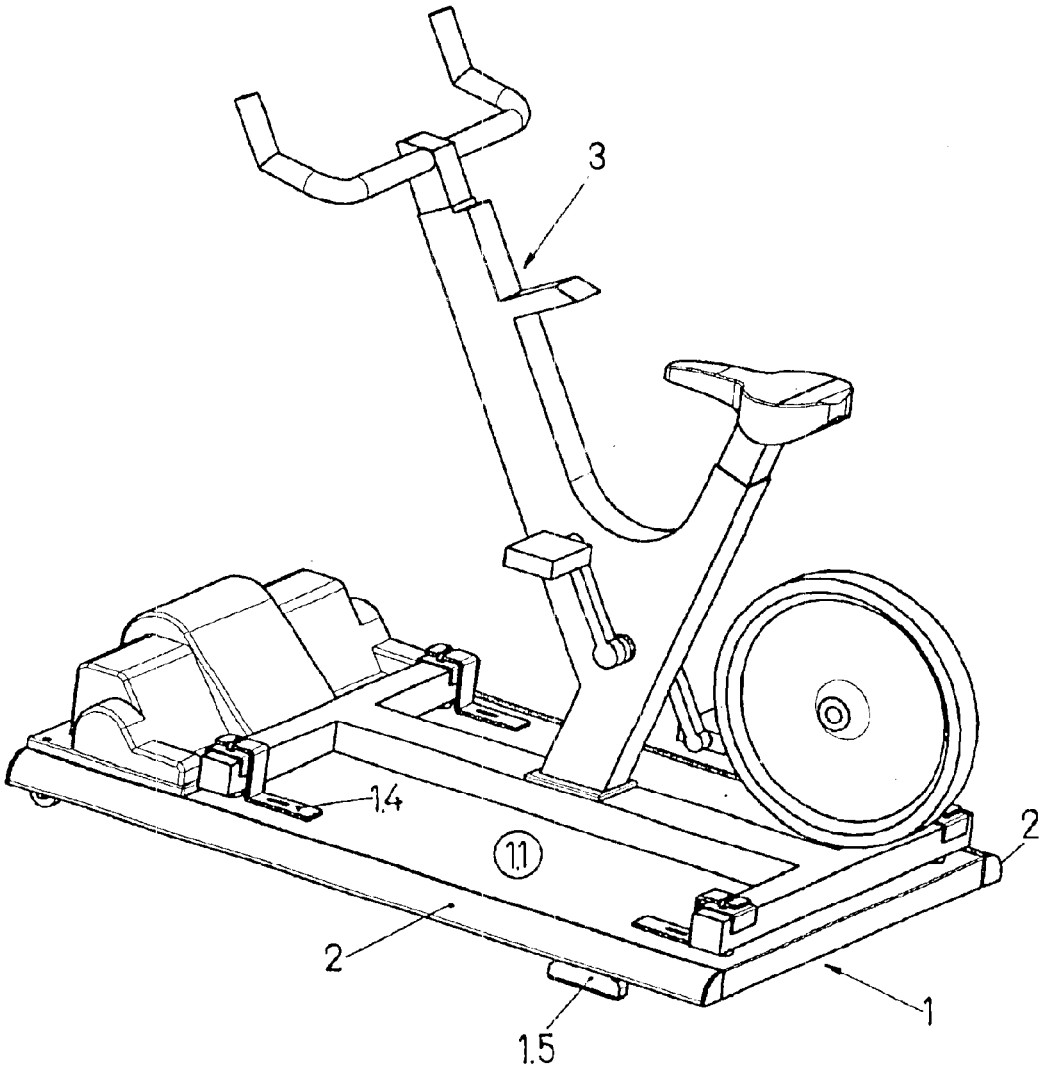
FIG. 1 is a prospective of the general mounting of the invention incorporating a conventional bicycle and with the curved section partially cut away to reveal the internal wheel.
Figure 2:
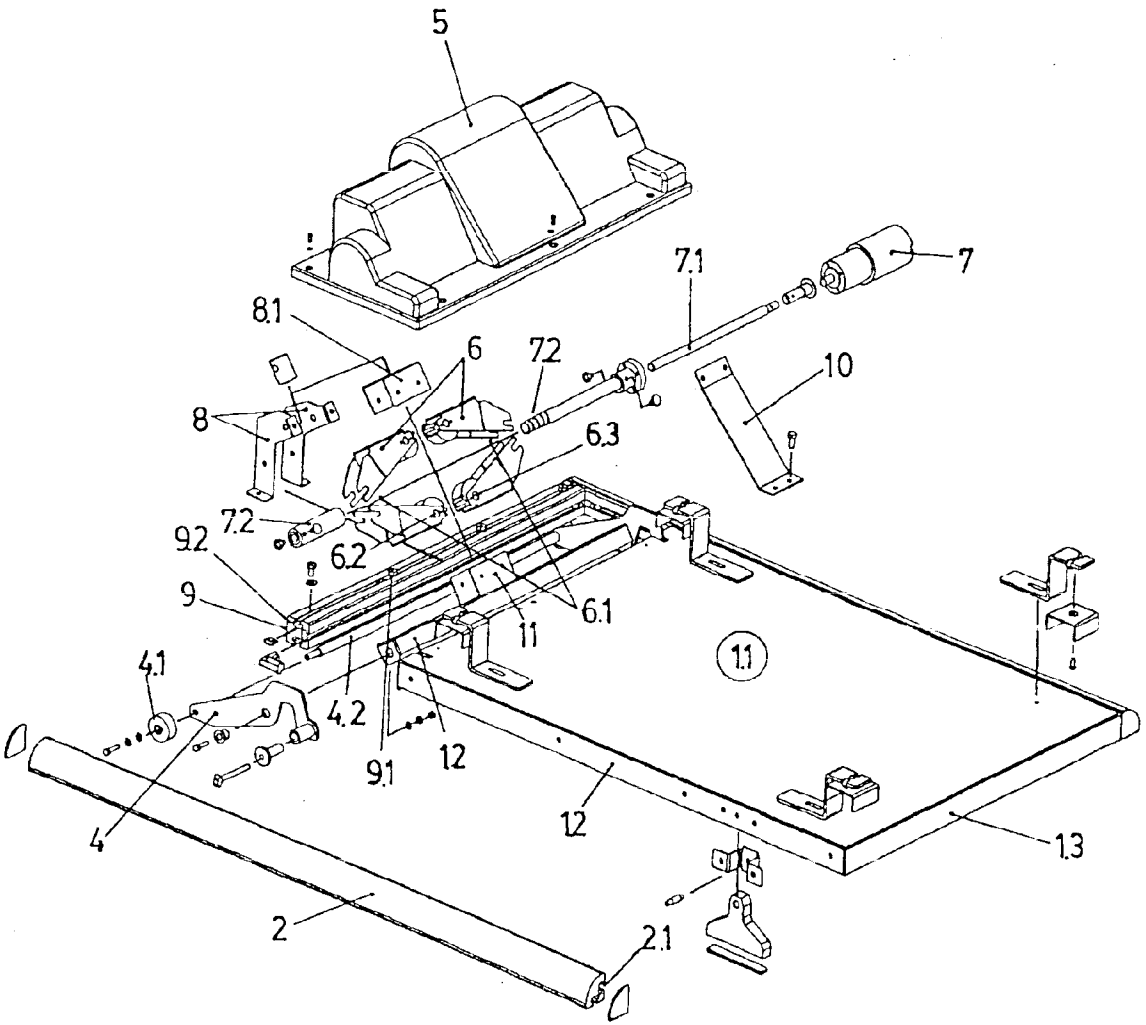
FIG. 2 shows a blow-up of the invention for the placing of the bicycle in the referred example.
Figure 3:
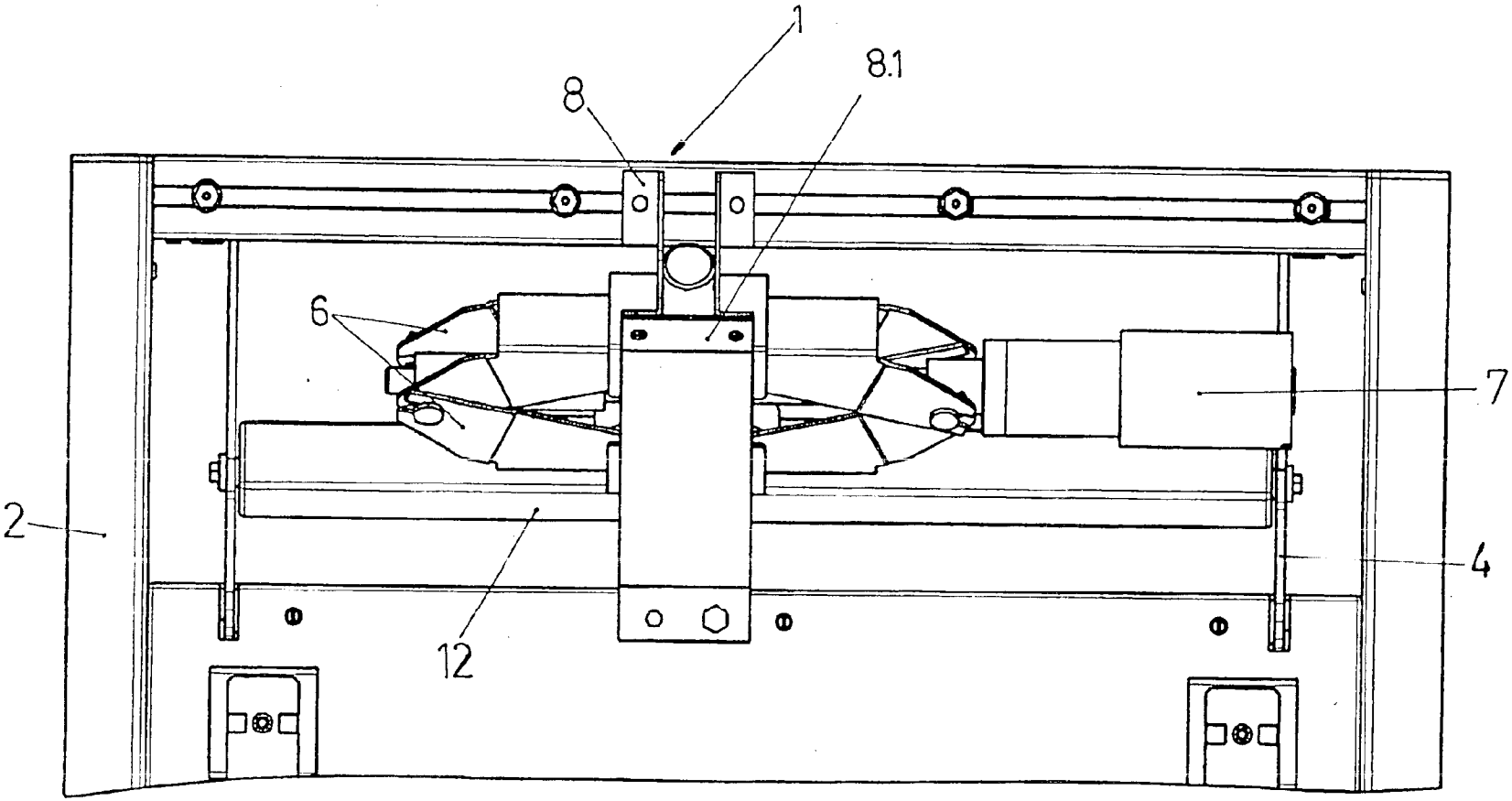
FIG. 3 shows a forward detail of the mounting, with the motor bringing the pincers to their point of maximum closing.
Figure 4:
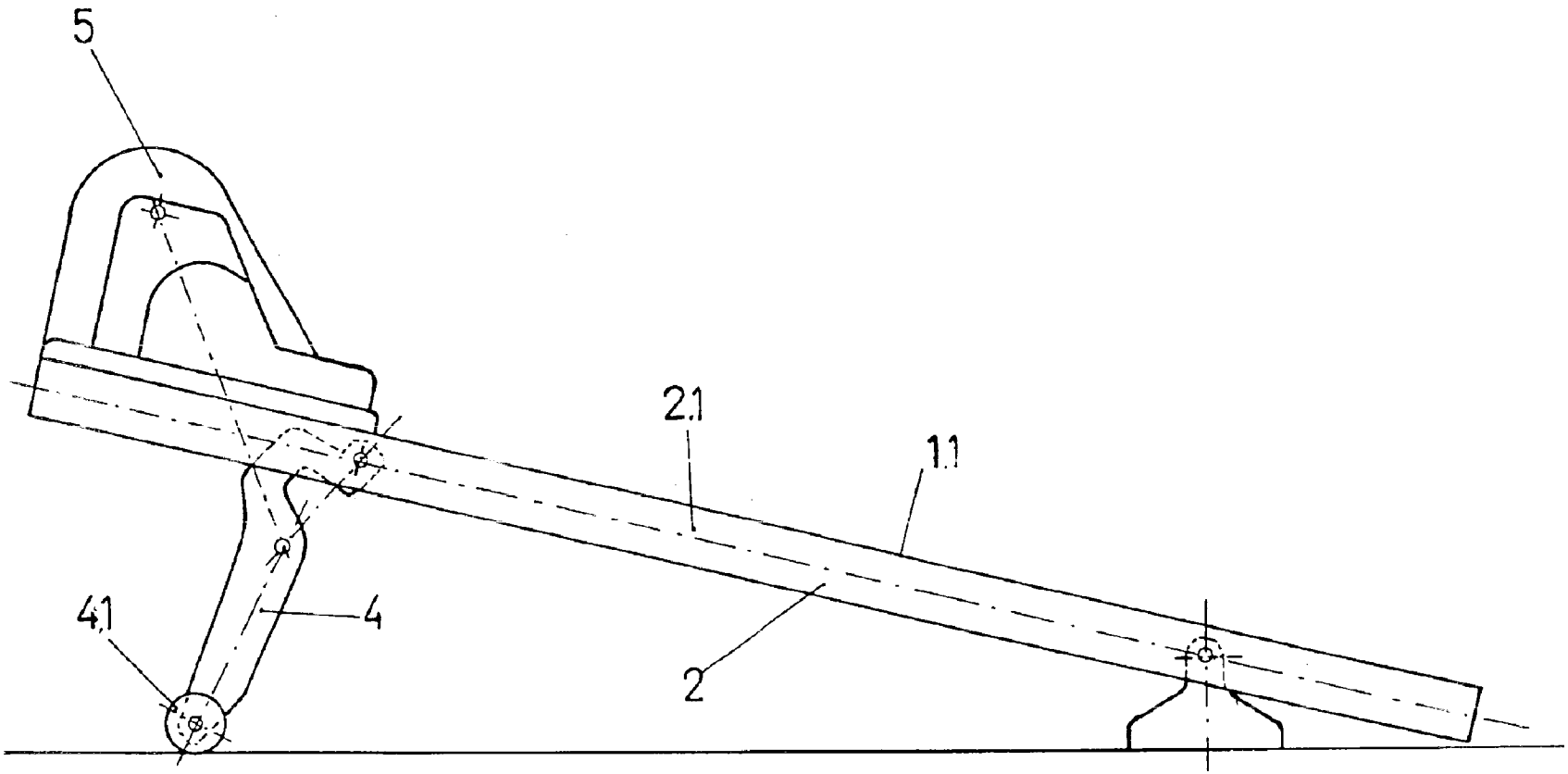
FIG. 4 is a sketch of the layout of maximum raising of the general mounting, obtained by retracting the extension of the axle and the resulting opening of the pincers.

In view of what has been previously set out, this invention refers to a raisable platform for stationary bikes, among the means of support of articles for the practice of stationary sports, essentially characterised by having a rectangular general mounting (1) pivoting about the back end, about a pair of irregular triangular plates (1.5), with a rounded and holed upper projection, to accept a hinging pin. The platform consisting of a base plate (1.1) with means of anchoring (1.4) stationary bikes (3) of every type and with sidc strips (1.2) and (1.3), with convex curved decorative anti-tripping covers (2) fitted to the larger strips, without hand-holes, that delimit a general frarne, with longitudinal cut-outs (2.1) for housing wheels (4.1) of a metal section (4).

A forward casing incorporates pincers (6), in an oblique layout, with opposing mouths (6.1) and with lips (6.2) and (6.3) that mutually self-embed in pairs, activated by a conventional electric motor (7), either step by step or with limit of run, with axle (7.1) extended and extendible by screwing (7.2) through the hinge of one of the pincers (6) with free passage to a rounded tubular housing (7.2) positioned firmly in the hinge of the opposite pincer, whose screwed position determines the opening of the opposing mouths (6.1) of both pincers (6).

The lips (6.2) of the pincers (6) are joined to a "U" (8.1) of the core of a forward support bridge (8), bolted to nuts (9.1) that slide along the guide (9.2) of the forward edge (9) of the frame, preferably of aluminium; an inclined metal strip (10) fixed at the edge of the base plate (1.1), complementing this support, so that the opening of the pincers (6) moves the wheels (4.1) along their path, based on which the metal sections (4) to whose ends they are attached, and that fixed at the other end to a transverse section (12), also joined to the "U" (11) that holds the lips (6.2) and (6.3) of these means of raising, pivots in its center, causing the raising of this metal section (4) and with it the general mounting (1), that, in turn, pivots with respect to the plate (1.5) and moving back the axle (4.2) of the forward wheels (4.1), producing an progressive unevening of the mounting (1) and with it, of the stationary bicycle (3), that reaches 34° with respect to the horizontal.

The inclination of the mounting assembly (I) and bicycle (3) can be set from a control incorporated in its handlebars or, for a group of these mounting (1) and bicycle (3) assemblies. It can be done remotely, by cable or by means of a remote control, and competitions and contests or sport exhibitions with a variety of bike users could even be held, in which a central computer programs a specific trip that sets out a large number of different rises and descents for the specific trip that reproduces the difficulties of a circuit, previously copying the ups and downs of its route and causing the mountings to follow with the desired precision the unevenness of each stretch, logically starting from an initial point that doesn't have negative slopes.

Variations in materials, shape, size and layout of the component parts, described in a non-limiting way, do not alter the essentialness of this invention; this being sufficient for its reproduction to be undertaken by an expert.

What is claimed is:

1. A raisable stationary bicycle assembly comprising a platform and a stationary bicycle attached to said platform, said platform comprising a pair of irregular triangular plates (1.5), each of said plates having a rounded and holed upper projection for receipt of a hinging pin; a rectangular general mounting having a back end pivotally mounted to said plates; and a forward casing comprising raisable means, said raisable means comprising:

(a) pincers (6), in oblique layout, with opposing mouths (6.1) and with lips (6.2 and 6.3) that mutually self-embed in pairs, activated by an axle (7.1);

(b) an electric motor (7) connected to the axle (7.1), said axle being extended and extendable by screwing (7.2) of the motor;

(c) a rounded tubular housing placed in a hinge of one of the pincers where is screwed the screwing (7.2) determining the opening of the opposite mouths (6.1) of both pincers;

(d) a support bridge which has a core (8.1) in "U" shape where the lips (6.2) of the pincers (6) are joined to;

(e) an inclined metal strip (10), fixed at an edge of a base plate;

(f) metal sections (4) fixed to a transverse section (12) also joined to a "U" shaped plate (11) that holds the lips (6.2 and 6.3); and (g) an axle (4.2) on which wheels (4.1) are fixed with respect to the general mounting.

2. The stationary bicycle assembly according to claim 1 further comprising a remote control for setting an inclination of the mounting (1) and stationary bicycle (3).

3. The raisable stationary bicycle assembly according to claim 1 further comprising a cable connected to a control for setting an inclination of the mounting (1) and bicycle (3).

4. The raisable stationary bicycle assembly according to claim 1 further comprising a computer for programming a selected simulated trip simulated by operation of the stationary bicycle.

5. The raisable stationary bicycle assembly according to claim 1 wherein said general mounting comprises a frame haiving a guide on a forward edge of said frame and said platform further comprises bolts that slide along said guide, said support bridge being bolted to said bolts, said lips (6.2) being joined to said U-shaped core (8.1).

6. The raisable stationary bicycle assembly according to claim 5 wherein said frame is made of aluminum.

* * * * *

UNITED STATES PATENT AND TRADEMARK OFFICE

CERTIFICATE OF CORRECTION

PATENT NO. : 6,855,096 B2
DATED : February 15, 2005
INVENTOR(S) : Quiros Granados It is certified that error appears in the above-identified patent and that said Letters Patent is hereby corrected as shown below:

Column 4,
Line 31, before the word "stationary", please insert -- raisable --.

Signed and Sealed this

Second Day of August, 2005

JON W. DUDAS
*Director of the United States Patent and Trademark Office*